US005081766A

United States Patent [19]

Kellum, Jr. et al.

[11] Patent Number: 5,081,766

[45] Date of Patent: Jan. 21, 1992

[54] METHOD OF MAKING AN ELECTRICALLY-OPERATED FLUID VALVE HAVING IMPROVED SEALING OF THE VALVE NEEDLE TO THE VALVE SEAT WHEN THE VALVE IS CLOSED

[75] Inventors: James A. Kellum, Jr., Seaford; Robert Lehman; James Parish, both of Newport News, all of Va.

[73] Assignee: Siemens Automotive L.P., Auburn Hills, Mich.

[21] Appl. No.: 596,166

[22] Filed: Oct. 11, 1990

[51] Int. Cl.[5] ..... B21D 53/00

[52] U.S. Cl. ..... 29/890.13; 29/418; 72/416

[58] Field of Search ..... 29/890.13, 890.122, 29/418, 428, 559; 72/30, 412, 416; 239/585, 533.13, 533.14, 533.2; 251/129.01, 129.13–129.15

[56] References Cited

U.S. PATENT DOCUMENTS

| | | | |
|---|---|---|---|
| 3,442,491 | 5/1969 | Messerschmidt | 29/890.13 |
| 3,608,171 | 9/1971 | Stradtmann | 29/890.13 |
| 4,248,075 | 2/1981 | Whitley | 72/416 |
| 4,413,393 | 11/1983 | Schils | 29/890.13 |
| 4,602,413 | 7/1986 | Krauss et al. | 29/890.122 |
| 4,688,312 | 8/1987 | Sasao et al. | 239/585 |
| 4,938,451 | 7/1990 | Weaver | 251/129.13 |

*Primary Examiner*—Irene Cuda

*Attorney, Agent, or Firm*—George L. Boller; Russel C. Wells

[57] ABSTRACT

A method of making an electrically-operated fluid valve for improving the metal-to-metal sealing of the valve needle to the valve seat, particularly of the rounded tip end of the needle to a frusto-conical depression in the seat. The method comprises applying a controlled axial compressive load to the seated needle to cause the annular zone of sealing contact between the needle and the seat to be coined.

7 Claims, 1 Drawing Sheet

METHOD OF MAKING AN ELECTRICALLY-OPERATED FLUID VALVE HAVING IMPROVED SEALING OF THE VALVE NEEDLE TO THE VALVE SEAT WHEN THE VALVE IS CLOSED

FIELD OF THE INVENTION

An electrically-operated, spring-biased fluid valve, wherein the valve element is an elongate metal needle having a rounded distal end and the valve seat is a a metal annulus containing a frusto-conical seating surface with which the distal end of the needle coacts. The invention relates to a method for improving the sealing of the needle's distal end to the seat's seating face so as to reduce fluid leakage through the valve hen the valve is in use and being operated closed.

BACKGROUND AND SUMMARY OF THE INVENTION

One of the uses of a fluid valve of the type to which the present invention relates is as a fuel injector for injecting a combustible fuel into a combustion engine. In the case of a spark-ignited, internal combustion engine for an automotive vehicle, the valve is typically under the control of an electronic control system and injects gasoline into the engine.

One of the chief reasons for using a fuel-injected engine is because of the ability to closely control the amount of fuel entering the engine. Close control over injected fuel is important for reasons of both fuel economy and exhaust emissions. When a fuel injector is closed, it should totally prevent fuel from leaking into the engine because such leakage can have undesired consequences. For example, even small amounts of leakage can adversely affect exhaust emissions in very significant ways. Certain countries now impose limits on the amounts of certain exhaust constituents that can be discharged to the atmosphere, and there is a trend toward making these limits even stricter. Accordingly, a commercially acceptable fuel injector is likely to have to comply with increasingly stringent limits on leakage.

Extremely costly manufacturing procedures could, of course, be invoked to insure precise surface finishes and fits of the cooperating parts by placing extremely small tolerances on the dimensions and surface finishes of the parts involved. Such activities would obviously increase the manufacturing costs, possibly to non-competitive prices for some companies. Alternate procedures that are less costly are therefore desirable.

The present invention relates to a new and unique method for reducing leakage in mass-produced fuel injectors of the type described at the beginning. The invention involves the inclusion of an additional step in the manufacturing process, but it eliminates the necessity for stricter tolerances on surface finish and part dimensions. Accordingly, manufacturing procedures that are presently in existence continue to enjoy vitality, and all that is needed to reduce leakage through the injector is the performance of what will be called for convenience a coining step. This coining step however does not involve the use of a coining die to coin a part; rather, it involves the application of axial compressive load to force the rounded distal end of the needle against the frusto-conical valve seat surface so that coining action occurs at an annular zone of surface contact between the two parts involved. The force application is preferably conducted in a particular manner so that the needle is neither irreversibly bent nor buckled by the coining step. This step is conducted during the manufacturing process so that neither the solenoid nor the spring which are parts of the operating mechanism in the completed injector has an influence on the result of the coining. Actual usage of the method of the invention has been found to to improve the yield of the mass-production process by approximately 10%, meaning that in a typical production run, that many more injectors will comply with applicable fuel leakage specifications when tested after assembly. This improvement reduces the number of injectors that have to be either re-worked or scrapped. Accordingly, the invention provides a significant improvement in the manufacturing process at the cost of only a single additional step. At that, the equipment needed to perform the additional step is neither extremely expensive nor complicated.

The foregoing features, advantages, and benefits of the invention, along with additional ones, will be seen in the ensuing description and claims which should be considered in conjunction with the accompanying drawings. The drawings disclose a presently preferred embodiment of the invention according to the best mode presently contemplated for carrying out the invention.

DESCRIPTION OF THE PREFERRED EMBODIMENT

Figure 1:
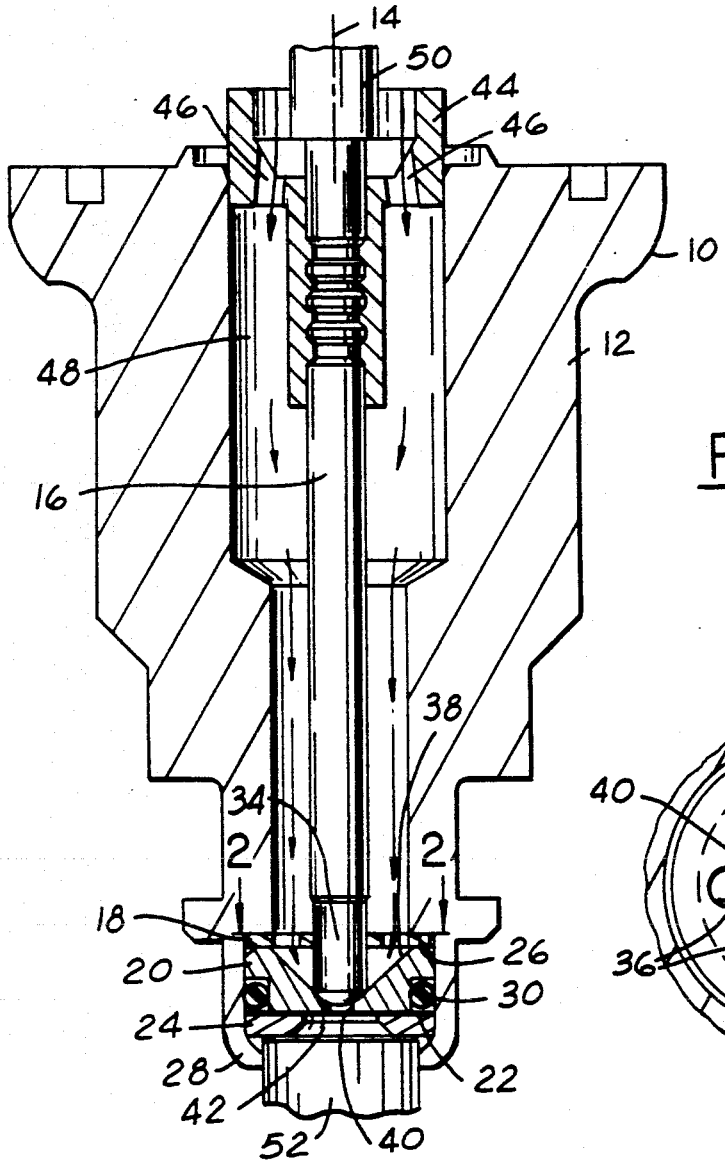
FIG. 1 is a longitudinal view, mainly in cross section, through a portion of a fuel injector during the manufacturing process.
Figure 2:
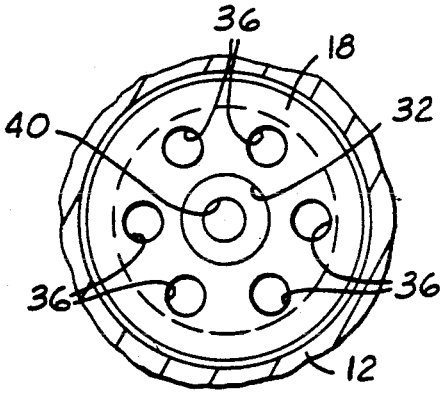
FIG. 2 is an enlarge fragmentary transverse cross sectional view taken in the direction of arrows 2—2 in FIG. 1 but omitting the valve element.

FIGS. 1 and 2 illustrate the tip end portion of a fuel injector 10 comprising: a generally tubular metal body 12 having a longitudinal axis !4; an elongate metal needle 16 disposed coaxial with axis 14 within body 12; and axially captured within body 12 at the distal end thereof, a stack composed of a metal needle guide member 18, a metal annulus 20, a thin metal orifice disc member 22, and a metal back-up ring 24, all four of which are coaxial with and transverse to axis 14. The stack is axially captured on body 12 between a distally facing internal shoulder 26 and a flange 28 of body 12, the latter having been crimped over the margin of the stack after the stack has been inserted through the open distal end of the body and against shoulder 26. An O-ring seal 30 is disposed in a circular groove extending around the outside of annulus 20 to seal between the stack and the I.D. of the body.

Needle guide member 18 has a central circular guide hole 32 through which a circular cylindrical portion 34 of needle 16 passes with a close sliding fit. A series of circular through-holes 36 are arranged in a circular pattern about hole 32.

Annulus 20 contains a depression 38 that is coaxial with axis 14 and that has a frusto-conical surface. A circular through-hole 40 extends from the bottom of depression 38 coaxial with axis 14.

Orifice disc member 22 contains one or more metering orifices in registry with through-hole 40.

Back-up ring 24 contains a central through-hole 42 that is in registry with the orifices of disc 22.

A bushing-like member 44 is attached to needle 16 adjacent the proximal end of the needle. Member 44 is shaped to leave the proximal end of the needle exposed. Member 44 has a close sliding fit with the inside of body 12 at the opposite end thereof from flange 28, and it also has several through-holes 46 that are eccentric to axis 14.

When the completed fuel injector is in use, pressurized liquid fuel that has been introduced into the injector passes through through-holes 46 in the sense indicated by the arrows and fills the annular space 48 surrounding needle 16 within body 12. Through-holes 36 serve to convey fuel from space 48 to fill depression 38 with pressurized fuel.

In the completed fuel injector, needle 16 is reciprocated axially to seat on and unseat from the valve seat that is formed by the frusto-conical depression 38. FIG. 1 illustrates the seated condition wherein the rounded distal end of the needle has an annular zone of sealing contact with the depression to thereby close through-hole 40, and hence prevent pressurized fuel from being emitted from the injector via the orifices in orifice disc 22. This represents the closed condition of the injector. The completed fuel injector has a helical coil spring (not appearing in the drawings) which exerts an axially directed bias force on the needle urging the rounded distal end thereof into forceful seating on depression 38. The spring bias is overcome by the energization of a solenoid coil (not shown in the drawings) which is operatively coupled to the needle. Solenoid energization lifts the needle from the seat to permit the injector to emit fuel from the injector's tip end.

The method of the present invention is conducted at a station of the assembly line on which the injectors are assembled. FIG. 1 represents that station. Essentially the station comprises a suitable fixture for supporting that much of an injector as is portrayed, preferably in an upright orientation. The station has a mechanism which is capable of axially clamping needle 16 and annulus 20 in such a manner that an axial compressive load can be applied to the clamped parts in a controlled manner.

FIG. 1 illustrates two elements of the station's mechanism, a support pin 50 and a push pin 52. The two are arranged coaxial and so that the parts to be clamped can be placed coaxially between them. The two pins are then relatively moved toward each other along axis 14 so that clamping occurs in the manner presented in FIG. 1. In this regard flange 28 circumscribes an opening sufficiently large to allow for through-passage of the distal end of push pin 52 into abutme... with back-up ring 24. Member 44 allows the distal end of support pin 50 to abut the proximal end of the needle. Preferably the abutment surfaces for the parts involved are flat and smooth, as shown.

Figure 3:
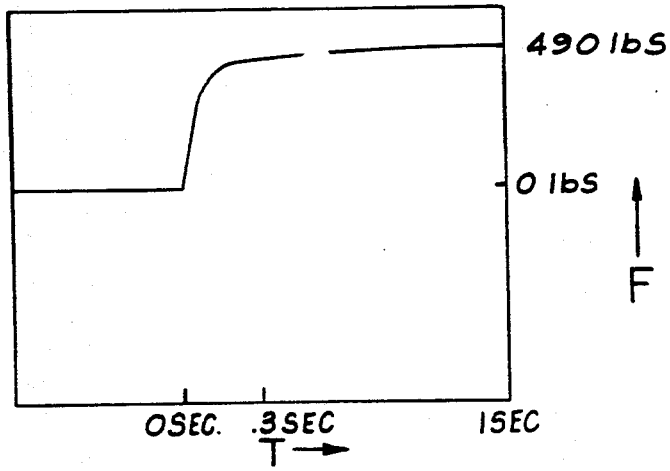
FIG. 3 is a graph plot for explaining certain aspects of the method.

With the clamping having occurred, the station's mechanism applies an axial compressive load to the clamped parts. FIG. 3 presents a graph plot of force vs. time. The compressive loading is built up to substantially maximum value over 0.3 seconds. The maximum force is held for an additional time which is at least as long as the 0.3 second build time and is preferably 0.7 seconds. Thereupon, the force is allowed to quickly decay. Pins 50, 52 are then retracted sufficiently to enable the partial injector to be moved to the next station in the assembly line.

The process that has just been conducted on the partial injector coins the annular zone of sealing contact between the rounded tip end of the seated needle and the frusto-conical shaped seat. This improves the seal and tends to reduce leakage that might otherwise occur through the closed fuel injector. By way of example, the needle and the annulus should have approximately the same hardness, Rc 56–60, and that of pins 50, 52 should be at least that hard, Rc 58–60 for example. The force that is applied should not irreversibly bend or buckle the needle. For a needle having a length of 28–30 mm., a diameter of 2 mm and a radius of 1.18–1.32 mm. for the rounded tip end, a maximum force of about 490 pounds has been successfully used.

While a presently preferred embodiment of the invention has been illustrated and described, it should be appreciated that the inventive principles may be practiced in other equivalent ways.

What is claimed is:

1. A method of making an electrically-operated, spring-biased fluid valve so as to reduce fluid leakage through the valve when the valve is in use and being operated closed, said valve being of the type which comprises for its movable valve element, an elongate metal needle that has a rounded distal end and that is susceptible to bending and/or buckling under axial compression loads exceeding permissible axial compression loading, and for its valve seat element, a metal disc annulus having a frusto-conical wall that circumscribes a through-hole and is coaxial with said needle, said fluid valve operating in response to electrical energization and de-energization thereof to open and close said through-hole by unseating and seating said rounded distal end of said needle from and on said frusto-conical wall, said method comprising disposing said needle and said annulus, free of the valve's electrical operation and spring bias, axially between a pair of aligned elements that are relatively movable toward and away from each other along the direction of said axis, relatively moving said pair of aligned elements toward each other to axially clamp said needle and annulus, and causing said pair of aligned elements to deliver to said needle and said annulus a controlled clamping force that acts to coin an annular zone of surface contact between said rounded distal end of said needle and said frusto-conical wall without irreversibly bending or buckling said needle.

2. A method as set forth in claim wherein said pair of aligned elements are caused to deliver said controlled clamping force in such a manner that the force builds to substantially its maximum value within about 0.3 seconds.

3. A method as set forth in claim 2 wherein after said force has built to substantially its maximum value, said pair of aligned elements are caused to maintain said force substantially at its maximum value for an additional time of at least 0.3 seconds before said force is allowed to decay.

4. A method as set forth in claim 3 wherein said pair of aligned elements are caused to maintain said force substantially at its maximum value for an additional time of 0.7 seconds before said force is allowed to decay.

5. A method as set forth in claim wherein said clamping force is delivered by causing one of said pair of aligned elements to bear directly against a proximal end of said needle that is opposite said distal end of said needle.

6. A method as set forth in claim 1 wherein said clamping force is delivered by causing one of said pair of aligned elements to bear directly against an annular back-up member of said valve that is itself disposed directly against said annulus.

7. A method as set forth in claim 1 wherein said clamping force is delivered by causing one of said pair of aligned elements to bear directly against a proximal end of said needle that is opposite said distal end of said needle and by causing the other of said pair of aligned elements to bear directly against an annular back-up member of said valve that is itself disposed directly against said annulus.

* * * * *